US007073426B1

(12) United States Patent
White

(10) Patent No.: US 7,073,426 B1
(45) Date of Patent: Jul. 11, 2006

(54) SOUND SUPPRESSOR

(75) Inventor: Mark White, P.O. Box 391, Pelham, AL (US) 35124

(73) Assignee: Mark White, Pelham, AL (US)

( * ) Notice: Subject to any disclaimer, the term of this patent is extended or adjusted under 35 U.S.C. 154(b) by 0 days.

(21) Appl. No.: 11/062,908

(22) Filed: Feb. 22, 2005

(51) Int. Cl.
*F41A 21/30* (2006.01)

(52) U.S. Cl. ..... 89/14.4; 181/223

(58) Field of Classification Search ..... 89/14.2, 89/14.3, 14.4; 181/223
See application file for complete search history.

(56) References Cited

U.S. PATENT DOCUMENTS

| | | | | | |
|---|---|---|---|---|---|
| 658,934 | A | * | 10/1900 | Washington et al. | 181/223 |
| 752,386 | A | * | 2/1904 | Dunlop et al. | 181/274 |
| 871,775 | A | * | 11/1907 | Blanchard et al. | 181/239 |
| 1,127,250 | A | * | 2/1915 | Humm | 181/223 |
| 1,127,892 | A | * | 2/1915 | Hornquist | 181/253 |
| 1,182,611 | A | | 5/1916 | Williams et al. | |
| 1,342,978 | A | * | 6/1920 | Young | 89/14.3 |
| 2,792,760 | A | * | 5/1957 | Hammer | 89/14.2 |
| 3,667,570 | A | * | 6/1972 | WerBell, III | 181/223 |
| 4,459,895 | A | * | 7/1984 | Mazzanti | 89/14.3 |
| 4,576,083 | A | * | 3/1986 | Seberger, Jr. | 89/14.4 |
| 4,584,924 | A | | 4/1986 | Taguchi | |
| 4,588,043 | A | | 5/1986 | Finn | |
| 4,907,488 | A | * | 3/1990 | Seberger | 89/14.4 |
| 4,974,489 | A | * | 12/1990 | Fishbaugh | 89/14.4 |
| 5,029,512 | A | * | 7/1991 | Latka | 89/14.4 |
| 5,164,535 | A | * | 11/1992 | Leasure | 89/14.4 |
| 5,361,677 | A | * | 11/1994 | Warner et al. | 89/14.2 |
| 5,679,916 | A | * | 10/1997 | Weichert | 89/14.4 |
| 6,079,311 | A | * | 6/2000 | O'Quinn et al. | 89/14.4 |
| 6,302,009 | B1 | * | 10/2001 | O'Quinn et al. | 89/14.4 |
| 6,308,609 | B1 | * | 10/2001 | Davies | 89/14.4 |
| 6,374,718 | B1 | * | 4/2002 | Rescigno et al. | 89/14.4 |
| 6,575,074 | B1 | * | 6/2003 | Gaddini | 89/14.4 |
| 6,837,139 | B1 | * | 1/2005 | Meyers | 89/14.2 |

FOREIGN PATENT DOCUMENTS

| | | | | |
|---|---|---|---|---|
| FR | 779665 | * | 4/1935 | 89/14.4 |
| FR | 1044376 | * | 11/1953 | 89/14.4 |

* cited by examiner

*Primary Examiner*—Michael J. Carone
*Assistant Examiner*—James S. Bergin

(57) ABSTRACT

A sound, flash and recoil suppressor for a firearm utilizing an outer tube or housing. Rear and front end caps are secured to the outer tube. A symmetrical blast baffle, and one or more asymmetrical baffles and spacers are typically positioned within the housing. The symmetrical blast baffle is the first baffle within the suppressor. It has a central hole, and one or more outer holes that are positioned near its periphery. Asymmetrical baffles consist of flat, elliptical plates that are positioned at an angle between 20 degrees and 80 degrees to the axis of the suppressor. The asymmetrical baffles may be arranged so that they are in parallel alignment, or they may be rotated slightly around the center of the bore's axis by up to 10 degrees right or left from each other.

7 Claims, 4 Drawing Sheets

FIG. 2 BLAST BAFFLE

FIG. 3 SLANT BAFFLE

SOUND SUPPRESSOR

BACKGROUND OF THE INVENTION

1. Field of the Invention

The Invention relates in general to firearms and the reduction of noise, flash and recoil resulting from the sudden release of gas from a firearm or cannon, from pneumatic tools and other devices such as paint ball guns, and also relates to a muffler or sound suppressor for an internal combustion engine. In particular, the invention relates to a sound, flash and recoil suppressor for firearms and cannons that comprises a housing containing a combination of symmetrical and asymmetrical baffles.

2. Description of the Prior Art

A wide variety of firearm sound suppressor devices currently exist. Many of these sound suppressor devices feature asymmetrical baffles or baffles that use some form of asymmetry to achieve high levels of sound and flash attenuation. Asymmetrical baffles produce high levels of turbulence within the sound suppressor, and this aids in producing high levels of sound and flash reduction. The use of purely asymmetrical baffles within a sound suppressor for a firearm often results in a major detrimental effect on the accuracy of the host firearm.

One difficulty with many prior art sound suppressor devices is that they require the addition of a liquid or oil or grease to achieve high levels of sound and flash reduction, although this may be dependent upon the caliber and type of firearm used. Low-powered firearms (such as pistols) are widely suppressed using suppressors that use a fluid to achieve greater sound and flash reduction levels. Due to the lower gas pressures of such firearms, the user may be able to fire the suppressed firearm up to 30 times before sound levels increase significantly. The suppressor may then require additional fluid. This method is not suitable for use with high-powered firearms due to the much higher pressures of the gases from these firearms. The higher pressures will rapidly flush the liquid or fluid additive out of the suppressor after only one or two shots. A very high risk of damage to the suppressed firearm exists if a liquid or fluid additive is used with a high-powered firearm since the fluid could back up into the firearm's bore.

U.S. Pat. No. 1,182,611 discloses a very early form of asymmetrical baffle. While the sound suppression system disclosed is modular or one-piece, the positions of the baffles vary. One metal flap or baffle is folded downward while the next baffle, positioned 180 degrees away and slightly forward from the preceding baffle, is folded inward so that the two baffles form a wedge-type structure. The next two baffles are similar but are rotated 90 degrees from the preceding pair of baffles. Successive pairs of baffles are again rotated 90 degrees from the preceding pair of baffles. The module disclosed utilized round tubing, and the one-piece system fitted snugly inside a round outer housing. This particular patent is for an internal combustion engine's exhaust muffler. While there is no provision for a hole to allow passage of a projectile, this feature could be easily added.

U.S. Pat. No. 4,584,924 discloses the use of asymmetrical slant baffles. While the sound and flash reduction achieved was fair, significant problems existed with the Taguchi or VAIME suppressor as it is more widely known. VAIME was the commercial manufacturer of the suppressor. Baffles were disclosed which were placed at an angle between thirty degrees and sixty degrees to the axis of the suppressor. Each following baffle was then rotated ninety degrees around the axis of the bore. The main problem with this arrangement was that the deflection of the gases away from the center axis of the suppressor was not enhanced by the rotation of the baffles. Another problem was that, while the baffles were asymmetrical, no symmetry was present in the form of a symmetrical structure in the initial expansion area of the suppressor. This degraded accuracy by causing bullet yaw during the initial part of the bullet's flight. Bullet yaw occurs when the bullet wobbles or moves from side to side. Only a slight amount of bullet yaw needs to occur for the bullet to strike a baffle or the end cap of the suppressor. The asymmetrical blast baffles used in the Taguchi/VAIME suppressor greatly enhanced bullet yaw.

Other problems that existed with the Taguchi/VAIME suppressor in its manufactured form included the use of soft, cast aluminum baffles in suppressors for powerful rifles. The first few baffles were not robust enough to deal with powerful blast forces. This construction technology was better suited to rim fire and low-pressure ammunition. Another problem with the Taguchi suppressor is that the angle used for the asymmetrical slant baffles was too shallow. While the Taguchi design achieved fair suppression with some calibers, the degree of sound suppression was only marginal with other calibers.

The Russians have also used the slant baffle technology. One Russian firearm that used such technology was a suppressed version of the Makarov pistol. This pistol was extensively modified, and used a perforated barrel to reduce the velocity of projectiles. The quick-connect muzzle suppressor featured three slant baffles in an arrangement similar to that used in the Taguchi/VAIME suppressor. The angle of the slant baffles is the same as the Taguchi/VAIME baffle. The arrangement was also similar in that the baffles were rotated 90 degrees. However, the baffles were more widely spaced, unlike the baffles used in the Taguchi/VAIME suppressor. The Russians also designed the suppressor internals as a module. The slant baffles were welded together which eliminated the need for separate spacer elements.

U.S. Pat. No. 4,588,043 discloses the use of a baffle that combines a bore aperture with a slanted sidewall. The slanted sidewall baffle results in effective sound and flash reduction. While it may be used with high-powered rifle calibers, the baffle structure is more suited to low-powered rounds such as those associated with pistols and submachine guns. The baffles disclosed in U.S. Pat. No. 4,588,043 all feature extensive machine cuts to enhance turbulence within the suppressor, considerably adding to the cost of production. If slanted sidewall baffles are used with high-powered rifle calibers, the bore aperture should not be too tight, since the slanted sidewall aperture greatly accentuates bullet yaw. The slanted sidewall aperture was used with baffles different from the three forms disclosed in U.S. Pat. No. 4,588,043. With high-powered, rifle caliber firearms, the bore aperture had to be reasonably wide, otherwise bullet yaw resulted in baffle and end cap strikes. To minimize baffle strikes with slanted sidewall baffles, the borehole must be increased in diameter. This, of course, has a detrimental effect on sound reduction levels. Close examination of a number of high-powered, rifle caliber suppressors that used slanted sidewall baffles showed wide evidence of baffle glances or baffle strike, and end cap strike. If the host rifle is intended for use as a sniper rifle, suppressors using slanted sidewall baffles should not be used.

It is an object of this invention to provide a sound, flash and recoil suppressor that produces high levels of sound and flash reduction. The suppressor uses a combination of symmetrical and asymmetrical baffles. When properly spaced, the baffles will have little or no significant detrimental effect on the accuracy of the projectile.

It is an object of this invention to provide a sound, flash and recoil suppressor based on an asymmetrical baffle design that produces high levels of sound and flash reduction with different calibers of ammunition. It is also an object of this invention to provide a sound suppressor that produces high levels of sound reduction without the use of fluid additives.

BRIEF SUMMARY OF THE INVENTION

According to the disclosed invention, a firearms sound suppressor device comprises an outer tube housing that has at least one symmetrical baffle and one asymmetrical baffle thereon. A symmetrical blast baffle is positioned at a 90 degree angle to the axis of the suppressor. The asymmetrical baffle is a flat elliptical plate that is positioned at an angle between 20 degrees and 80 degrees to the central axis of the suppressor. Separate spacer elements that are cylindrical are positioned within the tubular housing between the various baffles. These spacers separate, position, and align the symmetrical and asymmetrical baffles inside the body of the suppressor.

In a preferred embodiment, the sound suppressor utilizes an outer tube or housing. A rear end cap is secured to the outer tube that is threaded internally for attaching to the barrel of a firearm. At least one symmetrical blast baffle and a plurality of asymmetrical baffles and spacers are typically positioned within the housing. A front end cap is secured to the front of the outer tube. The front end cap has an aperture for projectiles to pass through, and serves to frontally encapsulate the plurality of baffles and spacers within the outer tube. The symmetrical blast baffle is placed nearest the muzzle of the firearm. It is the primary or first struck baffle within the suppressor. The symmetrical blast baffle has a borehole or aperture for the projectile to pass through. The blast baffle may have at least one or a plurality of outer holes that are positioned near the periphery of the symmetrical baffle. The asymmetrical baffles may vary in thickness, with the thickest baffle nearest the symmetrical blast baffle, and the thinnest baffle nearest the muzzle of the suppressor, or the baffles may be of a constant thickness. The asymmetrical baffles may be arranged so that they are all in parallel alignment, or they may be rotated slightly around the center of the bore's axis by up to 10 degrees right or left from the preceding asymmetrical baffle. The borehole or aperture in the asymmetrical baffles slightly increases in diameter as the baffles are positioned farther and farther away from the muzzle of the firearm. The asymmetrical baffles consist of flat plates that are positioned at angles between 20 degrees and 80 degrees to the axis of the suppressor.

BRIEF DESCRIPTION OF THE DRAWINGS

Referring particularly to the drawings for the purposes of illustration only, and not limitation.

DETAILED DESCRIPTION OF THE PREFERRED EMBODIMENT OF THE INVENTION

Figure 1:
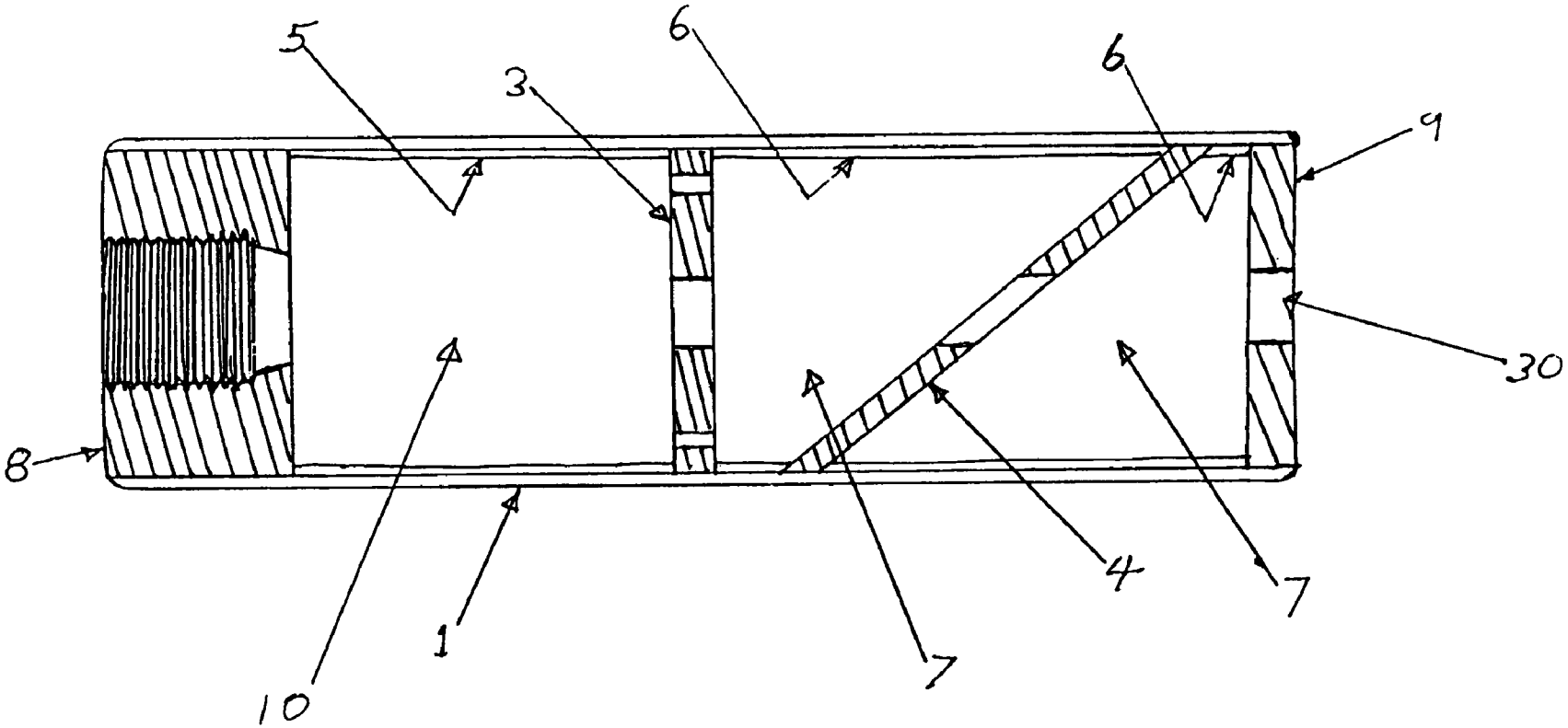
FIG. 1 is a cross-sectional view of the preferred embodiment of the invention showing a firearm sound suppressor.

FIG. 1 shows an embodiment of the sound suppressor that consists of a hollow cylindrical housing 1 with symmetrical baffle elements 3 and asymmetrical spacer baffle elements 4 and spacer elements 5 and 6 and 6*a* forming a series of expansion chambers 7 between the baffle elements 3 and 4. A rear end cap 8 and a front end cap 9 are secured to the housing 1, either by screw threads that are not shown or by welding the end caps 8 and 9 to the housing 1.

Figure 2:
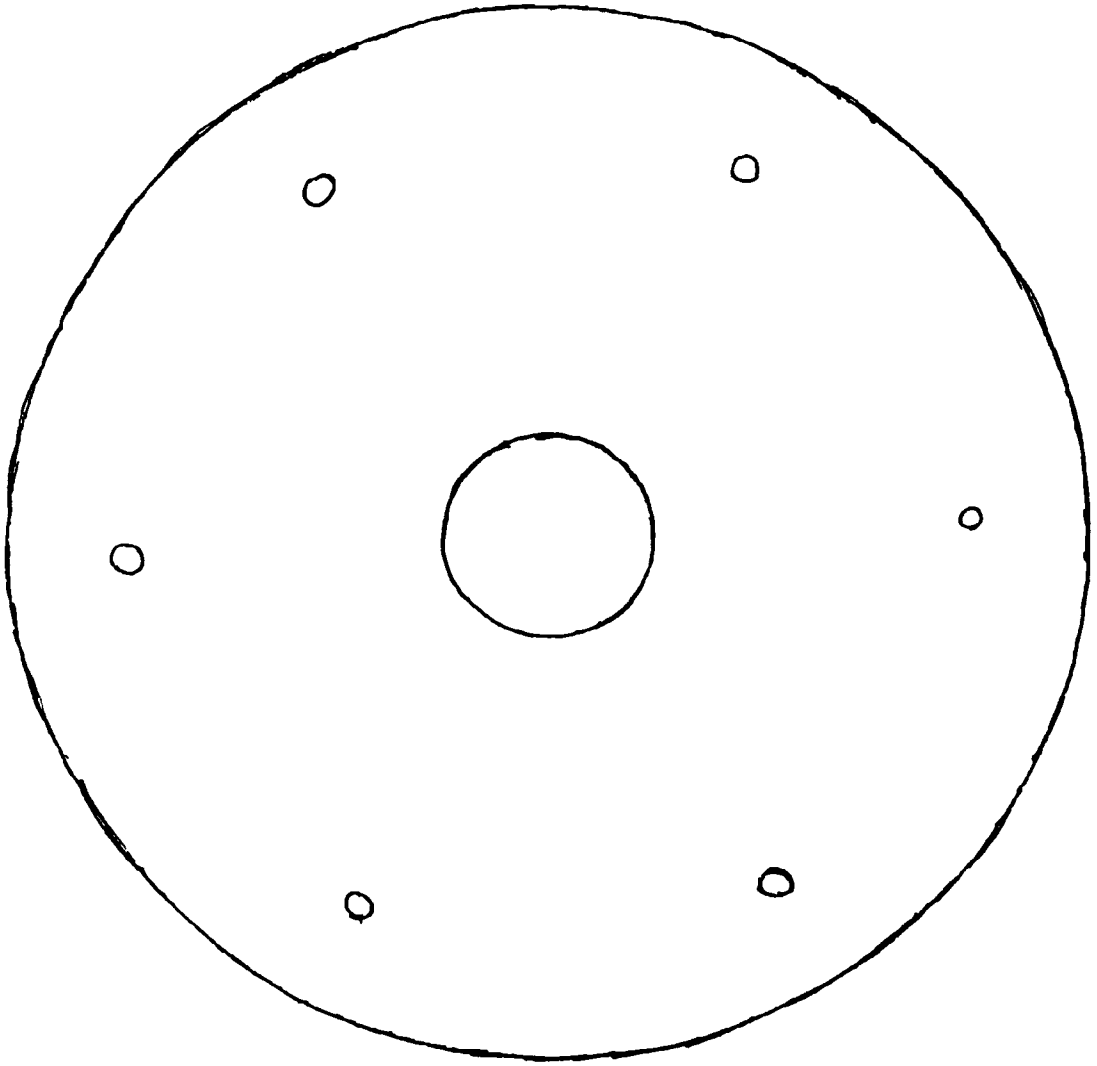
FIG. 2 is a rear face view of a symmetrical blast baffle as shown in FIG. 1.

A spacer element 5 is positioned between the rear end cap 8 and a symmetrical baffle element 3 forming an initial gas expansion chamber 10. FIG. 2 shows a rear face view of symmetrical baffle element 3 is a flat plate 12 with bore aperture 13 and a plurality of small gas vent holes 14 which are symmetrically positioned around the flat plate 12 and near the periphery or outer diameter of the flat plate 12. While FIG. 2 shows a plurality of small gas vent holes 14, it should be understood that these are shown for illustrative purposes only, and symmetrical baffle element 3 may not have said small gas vent holes in alternate embodiments.

While FIG. 2 is shown as a flat plate for illustrative purposes only, it should be understood that symmetrical baffle element 3 may be conical or may be a flat plate with a slightly conical surface near the bore aperture, or any symmetrical, geometric shape 13. The critical aspect of the symmetrical baffle element 3 is that it is placed at 90 degrees to the bore axis of the suppressor.

A spacer element 6 is positioned between the symmetrical baffle element 3 and the first asymmetrical baffle element 4 and spacer element 6 is provided with an angular surface at one edge, this angle matching the angle of the asymmetrical baffle element 4. Spacer element 6 may be rotated so that it may be used in an alternate position when positioned elsewhere in the suppressor housing 1. Asymmetrical baffle element 4 varies in angle from 20 degrees to 80 degrees when measured from a line perpendicular to the axis of the suppressor, and asymmetrical baffle 4 is provided with a bore aperture 11. For illustrative purposes only, the angle shown in FIG. 1 is 45 degrees, although in practice it has been found that this angle may vary dependent upon the caliber and degree of pressure of the host firearm.

Spacer elements 6*a* are positioned between a plurality of asymmetrical baffle elements 4 to space the baffle elements 4 apart in an optimum spacing for maximum reduction of sound, flash, and recoil. Spacer element 6 is positioned between the final baffle element 4 and the front end cap 9. When used in this position, spacer element 6 is rotated in such a manner that the angular surface of spacer element 6 is positioned to enable final baffle element 4 to be spaced and positioned correctly in relation to the front end cap 9. Spacer elements 6*a* are provided with angular surfaces on both edges and the angles match the angle of asymmetrical baffle elements 4.

Rear end cap 8 is shown with internal threads 20 which may mate with external threads on the end of a firearm barrel, or may mate with an adaptor that is detachably coupled to the end of a firearm barrel.

Front end cap 9 is shown with an exit aperture 30 for the exit of projectiles. Although rear end cap 8 and front end cap 9 are not shown with screw threads to allow secure attachment to housing 1, it should be understood that screw threads or other means such as welding or bonding may be used to secure attachment of rear end cap 8 and front end cap 9 to housing 1.

As the firearm is discharged, the projectile passes through rear end cap 8 and into the initial gas expansion chamber 10. Expansion chamber 10 is formed by the front edge of rear end cap 8 and the rear face of symmetrical baffle 3 and the inside surface of spacer element 5. Gases flow rapidly forward and expand into the expansion chamber 10 and overtake the projectile.

In this preferred embodiment, gases also flow forward through the one or more small gas vent holes 14 in symmetrical baffle 3; this diverts gases away from the central axis of the suppressor and from the bore aperture 13 of the symmetrical baffle 3. Symmetrical baffle 3 is the blast baffle of the suppressor. By definition, the blast baffle is the first baffle in the suppressor to come in contact with the hot, rapidly moving propellant gases. The function of the blast baffle is to take the brunt of abuse from the high-pressure and high-temperature propellant gases. The blast baffle also deflects the gases away from the path of the projectile and provides a more stable environment for the projectile to pass through, so that the projectile is less affected by turbulence created in the gas flow within the suppressor by the asymmetrical surfaces of the slant baffles 4. The blast baffle may be made of armor plate or some other form of hard, tough, wear-resistant ferrous or nonferrous alloy, steel, armor plate, carbon fiber, or synthetic material. Fabricating the blast baffle from hard, tough, wear-resistant alloy or steel or armor plate will ensure that the blast of particle-laden gas from each discharge of the firearm will not peen, deform or significantly erode the critical orifices and surfaces of the blast baffle.

The gases flow forward through one or more small gas vent holes 14 and through aperture 13 of the symmetrical baffle 3 and into an expansion chamber 7, which is formed between the front face of symmetrical baffle 3 and the rear face of the first asymmetrical baffle 4, and the inside surface of spacer element 6. Gases are deflected away from the axis of the suppressor by the downstream asymmetrical surface of baffle 4. The turbulence caused within expansion chamber 7 by the surface of baffle 4 causes the gases to take longer to exit before moving forward through bore aperture 11 to the next expansion chamber 7 that is formed between the front face of the first asymmetrical baffle 4 and the rear face of the next asymmetrical baffle 4 downstream and the inside surface of spacer element 6*a*. Gases flowing through the asymmetrical baffles are diverted downward, whereupon the flow strikes the face of each next baffle in turn. The flow then bounces upward, where it interferes with gas flow through the central borehole of the asymmetrical baffles.

Asymmetrical baffles 4 may be positioned in parallel, or the baffles may be rotated slightly around the center of the bore's axis by up to 10 degrees right or left from the preceding asymmetrical baffles, and a series of expansion chambers 7 are formed between the front and rear faces of slant baffles 4 and the inside surfaces of spacer elements 6*a*. Each succeeding slant baffle 4 deflects gases away from the axis of the suppressor creating turbulence within the series of expansion chambers 7. The gases are deflected downward and appear to induce a violent centrifugal vortex within each of the expansion chambers 7. This vortex is roughly perpendicular to the axis of the suppressor.

Once the gases from the series of expansion chambers 7 have exited these expansion chambers through the bore apertures, the gases pass into a final expansion chamber 7 that is formed by the front face of baffle 4, the rear face of front end cap 9 and the internal surface of spacer element 6. Spacer element 6 is positioned so that the angular surface is facing back toward the muzzle of the firearm, rather than away from the muzzle of the firearm which is the position used by spacer element 6 when it is positioned between the symmetrical baffle 3 and the first asymmetrical baffle 4. Once the gases have exited the final expansion chamber 7, they exit the suppressor through exit aperture 30 in the front end cap at a much reduced velocity, pressure, and temperature, thus significantly reducing the sound, flash and recoil levels of the host firearm.

Figure 3:
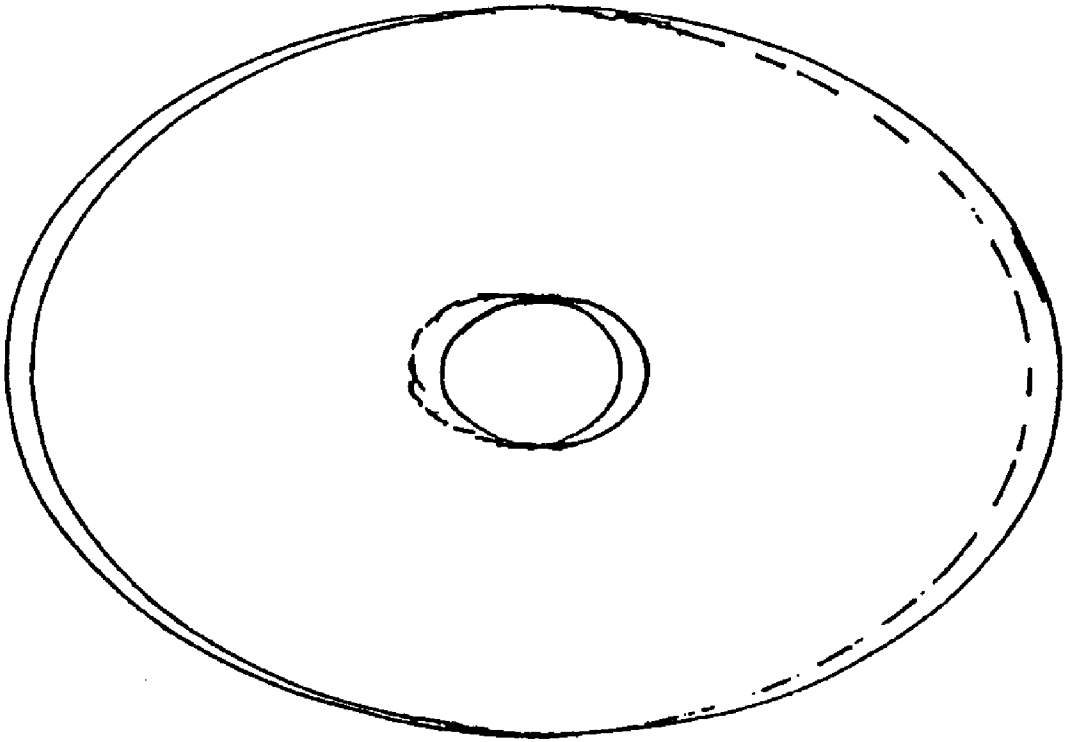
FIG. 3 is a side perspective view of a asymmetrical baffle element as shown in FIG. 1.
Figure 4:
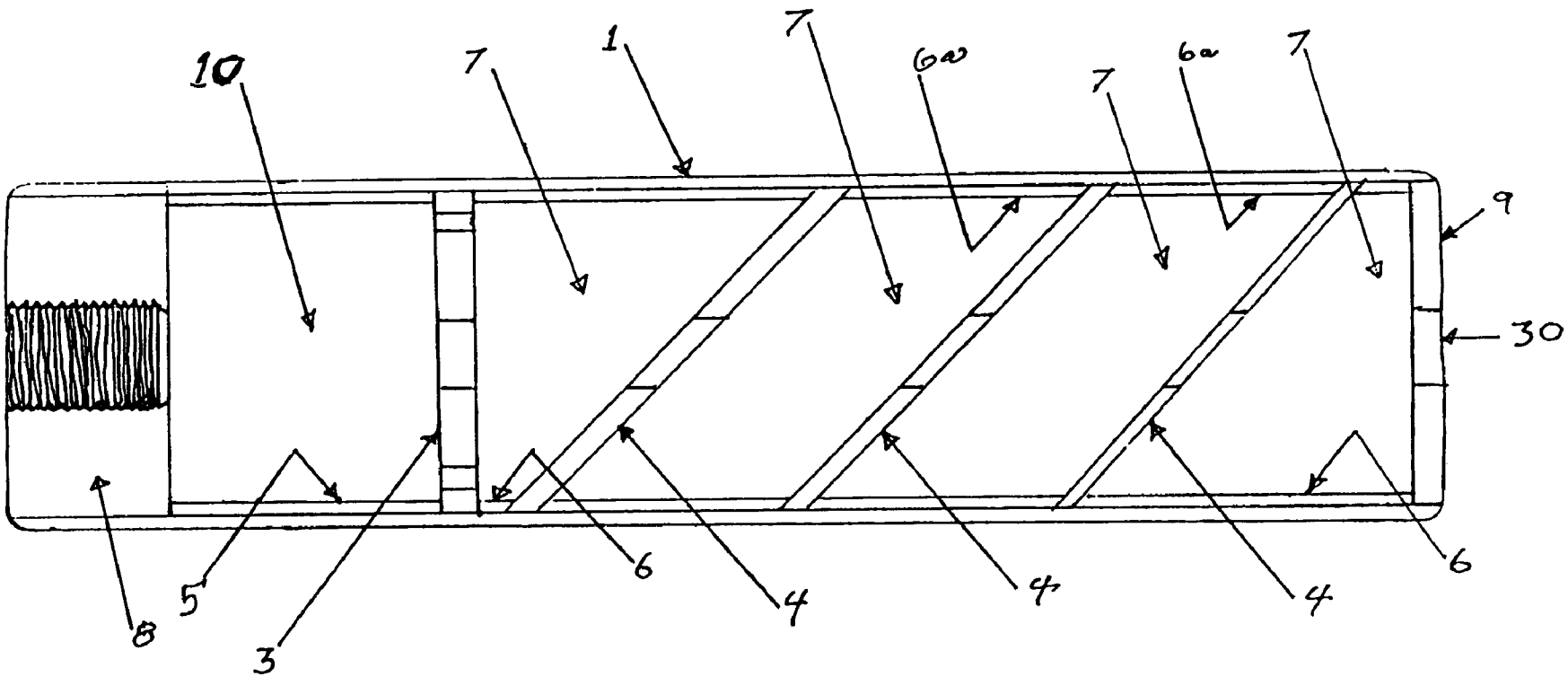
FIG. 4 is a side view of a cutaway, typical suppressor, complete.

FIG. 3 shows the asymmetrical baffle disclosed in this invention and its elliptical shape, and as disclosed prior, all of the asymmetrical baffles are positioned so that they may be placed parallel to each other or rotated slightly around the center of the bore's axis by up to 10 degrees right or left from the preceding asymmetrical baffle. The spacing of the asymmetrical baffles may be in a number of forms, either in decreasing distance as the baffles are positioned further away from the muzzle of the firearm, or the spacing may be of equal distance. Other optimal spacing distances may be used for the asymmetrical baffles, these being determined for each specific caliber and cartridge designation by experimentation. Regardless of the spacing used for the asymmetrical baffles, these baffles decrease in thickness the farther the distance from the muzzle of the firearm. However, in an alternate embodiment, the baffles may be of a constant thickness. The borehole in all of the baffles used, symmetrical or asymmetrical, increases in size slightly as each baffle is positioned farther away from the muzzle of the host firearm, this being to accommodate for the "cone of dispersion" of a projectile as it moves away from the muzzle of the host firearm.

While the baffles 3 and 4 and spacers 5, 6 and 6*a* are shown for illustrative purposes as separate elements within the suppressor, the elements within the suppressor may in practice be stacked together, screwed together, or welded together.

A critical aspect of utilizing asymmetrical baffles 4 is that they are all arranged in parallel alignment, as opposed to the Taguchi/VAIME system where the asymmetrical baffles were alternately rotated 90 degrees to each previous baffle. It has been found that parallel alignment of the asymmetrical baffles enhances the diversionary effect of the gases away from the axis of the suppressor. However, it has been found that some variation in asymmetrical baffle alignment by rotating around the center of the bore's axis by up to 10 degrees right or left from the preceding asymmetrical baffle is permissible while still maintaining the effectiveness of the asymmetrical baffle elements. The greater the pressure of the gases, the more effective the asymmetrical slant baffles are at redirecting and limiting gas flow within the suppressor. If more sound and flash suppression are required, it is simply a matter of adding extra asymmetrical baffles 4 and spacers 6.

Firearm recoil is generated by fast-moving propellant gases, which in most high-powered center fire rifles amounts to roughly 85 percent of the recoil. A sound suppressor can eliminate from 40 to 60 percent of felt recoil. Trapping the propellant gases and greatly reducing their terminal exit velocity will reduce the overall recoil of the suppressed firearm.

Muzzle flash occurs as a result of the contact of the propellant with the ambient air at the muzzle. At the muzzle the propellant gas mixture (containing traces of atomized, unburned powder and significant amounts of carbon monoxide gas) remains extremely hot. Oxygen in the surrounding air combines with the hot gas to enable combustion of the residual chemicals, resulting in a visible flash of light just beyond the end of the barrel. The result is known as primary flash. While there are other types of muzzle flash, such as intermediate and secondary flash, any type of flash is undesirable because it reveals the location of a military shooter at night or under low ambient light conditions. Due to its position-revealing properties, it is necessary to reduce muzzle flash in military small arms. There is also a type of muzzle flash and noise known as first-round pop that is unique to sound-suppressed firearms, especially if the suppressor is not used with any fluid additive such as water, grease, or other fluid-like material. First-round pop is caused when powder residue and hot gases combine with oxygen and re-ignite inside the suppressor. While sound suppressors can eliminate or reduce muzzle flash significantly, elimination of first-round pop can be hard to achieve without the use of a fluid additive. The quest to minimize or reduce first-round pop within the suppressor requires the use of special design techniques.

A major benefit of this invention is that it can be used with a wide variety of calibers of ammunition by changing the spacing and the angle of the asymmetrical baffles to ensure optimal performance for a specific cartridge and caliber of ammunition. The sound suppressor of this invention will function from .10 caliber through 20 mm and larger caliber ammunition.

Another major benefit is that by using a combination of symmetrical and asymmetrical baffles, minimization of projectile yaw or deviation is achieved. While purely asymmetrical baffles typically provide higher levels of sound reduction, a sound suppressor using asymmetrical baffles exclusively has been found to create significant projectile yaw and instability. A combination of symmetrical and asymmetrical baffles significantly reduces projectile yaw and strike variation.

A major benefit of this invention is that the sound reduction levels achieved using the symmetrical and asymmetrical baffle elements described herein are far greater than other prior art sound suppressors. While other prior art sound suppressors have required the use of a fluid additive to achieve comparable sound reduction levels, the use of fluids is not necessary with this invention.

Yet another benefit is that, while the invention is an effective sound suppressor for a firearm, it is also an effective muzzle flash suppressor and recoil suppressor.

While the sound suppressor as depicted and described herein is attached to a firearm barrel through the use of a thread or by other means, it is possible to have a sound suppressor of the invention as an integral part of a firearm barrel.

While the invention has been shown and described with reference to a certain specific preferred embodiment, modification may now suggest itself to those skilled in the art. One that comes to mind is utilizing more of the space or cubic content between the spacers and the outer tube to temporarily trap more of the propellant gas. Such modifications and various changes in form and detail may be made herein without departing from the spirit and scope of the invention. Accordingly, it is understood that the invention will be limited only by the appended claims.

What is claimed is:

1. A sound, flash and recoil suppressor for a firearm, comprising:

a cylindrical housing having a rear end cap attached to the housing and having means for mounting the sound suppressor to the muzzle of a firearm;

a front end cap attached to the cylindrical housing and having a centrally positioned aperture;

one symmetrical baffle element positioned within the cylindrical housing and between the rear end cap and the front end cap, with the symmetrical baffle element comprising a flat plate with a centrally positioned aperture;

a cylindrical spacer element positioned between the rear end cap and the symmetrical baffle element and forming an expansion chamber between said rear end cap and said symmetrical baffle element;

an asymmetrical baffle positioned within the cylindrical housing and between the symmetrical baffle and the front end cap, said asymmetrical baffle being elliptical in shape and having a central aperture which is larger than the caliber of the firearm, with the asymmetrical baffle being positioned at an acute angle which is between 20 degrees and 80 degrees to the axis of the housing;

a cylindrical spacer spacer element positioned between the symmetrical baffle element and the asymmetrical baffle element, with said spacer element having a rear edge that is perpendicular to the axis of the housing and a front edge that has an angular surface that is at said acute angle to the axis of the housing, and forming an expansion chamber between said symmetrical baffle element and said asymmetrical baffle element; and a cylindrical spacer element positioned between said asymmetrical baffle element and the front end cap, with said spacer element having a rear edge that is at an said acute angle to the axis of the housing, and a front edge that is perpendicular to the axis of said housing, and forming an expansion chamber between said asymmetrical baffle element and said front end cap.

2. A sound, flash and recoil suppressor for a firearm as claimed in claim 1, whereby said symmetrical baffle is modified by the addition of at least one or more gas ports positioned near the periphery or outside diameter of the symmetrical baffle.

3. A sound, flash and recoil suppressor for a firearm, comprising:

a cylindrical housing having a rear end cap attached to the housing and having means for mounting the sound suppressor to the muzzle of a firearm;

a front end cap attached to the cylindrical housing and having a centrally positioned aperture;

a symmetrical baffle element positioned within the cylindrical housing and between the rear end cap and the front end cap, with the symmetrical baffle element comprising a flat plate with a centrally positioned aperture;

a cylindrical spacer element positioned between the rear end cap and the symmetrical baffle element and forming an expansion chamber between said rear end cap and said symmetrical baffle;

a plurality of asymmetrical baffles positioned within the cylindrical housing and between the symmetrical baffle and the front end cap, said asymmetrical baffles being elliptical in shape and having a central aperture which is larger than the caliber of the firearm, with the asymmetrical baffles being positioned at an acute angle which is between 20 degrees and 80 degrees to the axis of the housing, and said plurality of asymmetrical baffle elements positioned within the cylindrical housing between the symmetrical baffle element and front end cap in a spaced relationship, and being positioned in parallel to each other;

a plurality of cylindrical spacer elements positioned within the cylindrical housing between the asymmetrical baffle elements with said spacer elements having rear and front edges that are at said acute angle to the axis of the housing, and forming a series of expansion chambers between the rear and front faces of said plurality of asymmetrical baffle elements;

a cylindrical spacer element positioned between the symmetrical baffle element and the first asymmetrical baffle element, with said spacer element having a rear edge that is perpendicular to the axis of the housing and a front edge that has an angular surface that is at said acute angle to the axis of the housing, and forming an expansion chamber between said symmetrical baffle element and said asymmetrical baffle element; and a cylindrical spacer element positioned between the final asymmetrical baffle element and the front end cap, with said spacer element having a rear edge that is at said acute angle to the axis of the housing, and a front edge that is perpendicular to the axis of said housing, and forming an expansion chamber between said asymmetrical baffle element and said front end cap.

4. A sound, flash and recoil suppressor, as claimed for in claim 3, whereby said symmetrical baffle is modified by the addition of at least one or more gas ports positioned near the periphery or outside diameter of the symmetrical baffle.

5. A sound, flash and recoil suppressor, as claimed for in claim 3, whereby the plurality of asymmetrical baffles decrease in thickness with respect to the distance from the rear end cap of the suppressor.

6. A sound, flash and recoil suppressor for a firearm, as claimed for in claim 3, whereby at least one asymmetrical baffle is rotated around the center of the bore's axis by up to 10 degrees right or left with respect to the preceding asymmetrical baffle.

7. A sound, flash and recoil suppressor for a firearm, as claimed for in claim 3, where a plurality of asymmetrical baffles are rotated around the center of the bore's axis by up to 10 degrees right or left with respect to the preceding asymmetrical baffle.

* * * * *